US005080177A

United States Patent [19]

Robin et al.

[11] Patent Number: 5,080,177

[45] Date of Patent: Jan. 14, 1992

[54] FIRE EXTINGUISHING METHODS UTILIZING 1-BROMO-1,1,2,2-TETRA-FLUOROETHANE

[75] Inventors: Mark L. Robin; Yuichi Iikubo, both of W. Lafayette, Ind.

[73] Assignee: Great Lakes Chemical Corporation, West Lafayette, Ind.

[21] Appl. No.: 557,950

[22] Filed: Jul. 26, 1990

[51] Int. Cl.[5] ..... A62C 39/00; A62D 1/00

[52] U.S. Cl. ..... 169/46; 169/44; 252/2; 252/8

[58] Field of Search ..... 169/44, 46, 47, 43; 252/2, 8

[56] References Cited

U.S. PATENT DOCUMENTS 3,684,018 8/1972 Rainaldi et al. ..... 252/8 X
3,844,354 10/1974 Larsen ..... 169/46
4,668,407 5/1987 Gerard et al. ..... 169/46 X

FOREIGN PATENT DOCUMENTS 383443 8/1990 European Pat. Off. ..... 252/2

OTHER PUBLICATIONS

*Halogenated Fire Suppressants*, C. L. Ford, R. G. Gann, ed., ACS Symposium, Series 16.

*Primary Examiner*—Johnny D. Cherry
*Assistant Examiner*—James M. Kannofsky
*Attorney, Agent, or Firm*—Woodard, Emhardt, Naughton, Moriarty & McNett

[57] ABSTRACT

1-Bromo-1,1,2,2-tetrafluoroethane is a low ozone-depleting fire extinguishing agent used alone or in blends with other compounds in total flooding and portable systems.

8 Claims, No Drawings

FIRE EXTINGUISHING METHODS UTILIZING 1-BROMO-1,1,2,2-TETRA-FLUOROETHANE

BACKGROUND OF THE INVENTION

1. Field of the Invention

This invention relates extinguishing methods utilizing 1-Bromo-1,1,2,2-tetra-fluoroethane, $HCF_2CF_2Br$.

2. Description of the Prior Art

The use of certain bromine, chlorine and iodine-containing halogenated chemical agents for the extinguishment of fires is common. These agents are in general thought to be effective due to their interference with the normal chain reactions responsible for flame propagation. It is taught in the art that the effectiveness of the halogens is in the order I>Br>Cl>F, for example, C.L. Ford, in Halooenated Fire Suooressants, R.G. Gann, ed., ACS Symposium Series 16.

The use of iodine-containing compounds as fire extinguishing agents has been avoided primarily due to the expense of their manufacture or due to toxicity considerations. The three fire extinguishing agents presently in common use are all bromine-containing compounds, bromotrifluoromethane ($CF_3Br$), bromochlorodifluoromethane ($CF_2BrBI$), and dibromotetrafluoroethane ($BrCF_2CF_2Br$). Although a number of compounds have been considered as potential extinguishing agents, 1-bromo-1,1,2,2-tetrafluoro-ethane is not among them.

Although the above named bromine or chlorine-containing agents are effective in extinguishing fires, totally halogenated agents such as $CF_3Br$ and $CF_2BrCl$, containing bromine or chlorine are asserted by some to be capable of the destruction of the earth's protective ozone layer.

It is therefore an object of this invention to provide a method for extinguishing fires that extinguishes fires as rapidly and effectively as the presently employed agents, and is environmentally safe with respect to ozone depletion.

SUMMARY OF THE INVENTION

The foregoing and other objects, advantages and features of the present invention may be achieved by employing 1-bromo-1,1,2,2-tetrafluoroethane ($HCF_2CF_2Br$) and blends thereof with other compounds as fire extinguishants for use in fire extinguishing methods and apparatus. More particularly, the method of this invention involves introducing to a fire 1-bromo-1,1,2,2-tetrafluoroethane in a fire extinguishing concentration and maintaining such concentration until the fire is extinguished. 1-Bromo-1,1,2,2-tetrafluoroethane may be used alone or in admixture with other compounds, optionally in the presence of a propellant. Generally 1-bromo-1,1,2,2-tetra-fluoroethane or its mixtures with other compounds are employed in the range of about 1 to 15%, preferably 3 to 10%, on a v/v basis.

DESCRIPTION OF THE PREFERRED EMBODIMENTS

In accordancde with the present invention, 1-bromo-1,1,2,2-tetrafluoroethane has been found to be an effective fire extinguishing agent at concentrations safe for use. However, because 1-bromo-1,1,2,2-tetrafluoroethane contains a hydrogen atom, it has a very low ozone depletion potential due to its removal in the troposphere via reaction with hydroxyl radicals. For example, employing the method of Babson for the estimation of ozone depletion (ODP) values, 1-bromo-1,1,2,2-tetrafluoroethane has an ODP of 1.00, compared to ODP values of 14.26 and 2.65 for the presently employed agents $CF_3Br$ and $CF_2BrCl$, respectively, a reduction in ODP of greater than 62% in each case.

1-Bromo-1,1,2,2-tetrafluoroethane has an LC50 value (concentration necessary to cause death in half of test subjects) of 19% v/v as reported in Int. J. Quantum Chem., Q Biol Symp 3, 171 (1976), and hence is effective at concentrations well below levels harmful to living things.

1-Bromo-1,1,2,2-tetrafluoroethane may be used alone or in admixture with other compounds, optionally in the presence of a propellant. Among the compounds with which 1-bromo-1,1,2,2-tetrafluoroethane may be blended are chlorine and/or bromine containing compounds such as $CF_3Br$, $CF_2BrCl$, $CF_3CF_2Cl$, and $BrCF_2CF_2Br$. Other compounds forming useful blends with, 1-bromo-1,1,2,2-tetrafluoro-ethane include $CF_2HBr$, $CF_3CHFBr$, $CF_3CF_2H$, $CF_3CHFCF_3$, $CF_3CHFCl$, $CF_3CHCl2$, $CF_4$, $CF_3H$ and similar fluorocarbons. 1-Bromo 1,1,2,2,-tetrafluoroethane may also be used in the presence of a propellant, such as $N_2$, $CO_2$ or Ar.

Where 1-bromo-1,1,2,2-tetrafluoroethane is employed in blends, it is desirably at a level of at least about 5 percent by weight of the blend. 1-Bromo-1,1,2,2-tetra-fluoroethane is preferably employed at high enough levels in such blends so as to minimize the adverse environmental effects of chlorine and bromine containing compounds.

1-Bromo-1,1,2,2-tetrafluoroethane may be effectively employed at substantially any minimum concentration at which the fire may be extinguished, the exact minimum level being dependent on the particular combustible material, and the combustion conditions. In general, best results are achieved where 1-bromo-1,1,2,2-tetrafluoroethane or mixtures and blends are employed at a level of about 4% (v/v). Likewise the maximum amount to be employed will be governed by matters of economics and potential toxicity to living things. About 15% provides a convenient maximum for use of 1-bromo-1,1,2,2-tetrafluoroethane and its mixtures thereof in occupied areas. Concentrations above 15% may be employed in non-occupied areas, with the exact level determined by the particular combustible material and the conditions of combustion.

1-Bromo-1,1,2,2-tetrafluoroethane may be applied using conventional application techniques and methods used for agents such as $CF_3Br$ and $CF_2BrCl$. Thus, the agents may be used in total flooding systems, portable systems or specialized systems. Thus, as is known to those skilled in the art, 1-bromo-1,1,2,2-tetrafluoroethane may be pressurized with nitrogen or other inert gas at up to about 600 psig at ambient conditions.

Practice of the present invention is illustrated by the following examples, which are presented for purposes of illustration but not of limitation.

EXAMPLE 1

Concentrations of agent required to extinguish diffusion flames of n-heptane were determined using the cup burner method. Agent vapor was mixed with air and introduced to the flame, with the agent concentration being slowly increased until the flow was just sufficient to cause extinction of the flame. The data are reported in Table 1 , which demonstrate the effectiveness of $HCF_2CF_2Br$. Values for $CF_3Br$ and $CF_2BrCl$ are included for reference purposes.

TABLE 1

| Extinguishment of n-heptane Diffusion Flames | | | | |
|---|---|---|---|---|
| | Air flow | Agent Required | Extinguishing Conc. | |
| Agent | cc/min | cc/min | % v/v | mg/L |
| $HCF_2CF_2Br$ | 16,200 | 535 | 3.2 | 236 |
| $CF_2BrCl$ | 16,200 | 546 | 3.3 | 222 |
| $CF_3Br$ | 16,200 | 510 | 3.1 | 189 |

EXAMPLE 2

The procedure of example 1 was repeated employing n-butane as fuel. Results are shown in Table 2, and demonstrate the efficacy of $HCF_2CF_2Br$ for extinguishment of fires.

TABLE 2

| Extinguishment of n-Butane Diffusion Flames | | | | |
|---|---|---|---|---|
| | Air flow | Agent Required | Extinguishing Conc. | |
| Agent | cc/min | cc/min | % v/v | mg/L |
| $HCF_2CF_2Br$ | 16,200 | 421 | 2.5 | 185 |
| $CF_2BrCl$ | 16,200 | 420 | 2.5 | 168 |
| $CF_3Br$ | 16,200 | 396 | 2.4 | 146 |

It can be seen from eh tables that $HCF_2CF_2Br$ is as effective as the presently employed fire extinguishing agents $CF_3Br$ and $CF_2BrCl$. The use of $HCF_2CF_2Br$ in accordance with this invention is highly effective and its use avoids the significant environmental handicaps encountered with totally halogenated agents.

We claim:

1. A method of extinguishing a fire comprising the steps of introducing to fire a fire extinguishing concentration of 1-bromo-1,1,2,2-tetrafluoroethane, and maintaining the fire extinguishing concentration until the fire is extinguished.

2. The method of claim 1 wherein the 1-bromo-1,1,2,2-tetrafluoroethane is introduced to the fire at a concentration relative to the air surrounding the fire of less than 15% (v/v).

3. The method of claim 1 wherein the 1-bromo-1,1,2,2-tetrafluoroethane is introduced to the fire at a concentration relative to the air surrounding the fire of from 3 to 10% (v/v).

4. The method of claim 1 wherein said introducing step includes introducing the 1-bromo-1,1,2,2-tetrafluoroethane through a total flooding system.

5. The method of claim 1 wherein said introducing step includes introducing the 1-bromo-1,1,2,2-tetrafluoroethane through a portable extinguishing system.

6. The method of claim 1 further including the sep of propelling the 1-bromo-1,1,2,2-tetrafluoroethane with a compound selected from h group consisting of nitrogen, $CO_2$, and argon.

7. A method for extinguishing a fire comprising the steps of:

introducing to the fire a fire extinguishing concentration of a mixture comprising:

$HCF_2CF_2Br$, and at least one compound selected form the group consisting of $CF_3Br$, $CF_2BrCl$, $BrCF_2CF_2Br$, $CF_3CHFBr$, $CF_3CHCl_2$, $CF_3CHFCl$, $CF_3CF_2Cl$, $CF_3CF_2H$, $CF_3CHFCF_3$, $CF_2HCl$, $CF_3H$ and $CF_4$, wherein the $HCF_2CF_2Br$ is at a level of at least 1% by weight of the mixture; and maintaining the fire extinguishing concentration of the mixture until the fire is extinguished.

8. The method of claim 7 further including the step of propelling the mixture with a compound selected from eh group consisting of nitrogen, $CO_2$, and argon.

* * * * *

UNITED STATES PATENT AND TRADEMARK OFFICE

CERTIFICATE OF CORRECTION

PATENT NO. : 5,080,177

DATED : January 14, 1992

INVENTOR(S) : Mark L. Robin and Yuichi Iikubo

It is certified that error appears in the above-identified patent and that said Letters Patent is hereby corrected as shown below:

In Column 1, line 87 after the word relates insert --to fire--.

In Column 1, line 17 change "Halooenaated" to --Halogenated--.

In Column 1, line 17 change "Suooressants" to --Suppressants--.

In Column 1, line 25 change "($CF_2BrBI$)" to --$CF_2BrCl$--.

In Column 1, line 60 change "accordancde" to --accordance--.

In Column 3, line 29 change "eh" to --the--.

In Column 3, line 37 insert after to and before fire --the--.

In Column 4, line 17 change "sep" to --step--.

In Column 4, line 19 change "h group" to --the group--.

In Column 4, line 37 change "eh" to --the--.

Signed and Sealed this

Twenty-second Day of June, 1993

*Attest:*

Michael K. Kirk

MICHAEL K. KIRK

*Attesting Officer*

*Acting Commissioner of Patents and Trademarks*